US007654410B2

(12) United States Patent
Prince et al.

(10) Patent No.: US 7,654,410 B2
(45) Date of Patent: Feb. 2, 2010

(54) VEHICLE RESERVOIR TANK

(75) Inventors: Antonio Prince, Lake Orion, MI (US); John R. Young, Royal Oak, MI (US)

(73) Assignee: Nissan Technical Center North America, Inc., Farmington Hills, MI (US)

( * ) Notice: Subject to any disclaimer, the term of this patent is extended or adjusted under 35 U.S.C. 154(b) by 672 days.

(21) Appl. No.: 11/342,619

(22) Filed: Jan. 31, 2006

(65) Prior Publication Data

US 2007/0175418 A1 Aug. 2, 2007

(51) Int. Cl.
*B65D 88/12* (2006.01)
*B60P 3/00* (2006.01)

(52) U.S. Cl. ..... 220/564; 220/562; 220/563; 220/4.12; 220/500; 220/501; 220/745; 220/746; 220/747; 220/748

(58) Field of Classification Search ..... 220/562, 220/563, 564, 4.12, 500, 501, 4.13, 555, 220/745, 746, 747, 748; 137/583, 587; 123/14.51, 123/41.54
See application file for complete search history.

(56) References Cited

U.S. PATENT DOCUMENTS 1,563,199 A * 11/1925 Leland ..... 220/747
1,909,336 A * 5/1933 Castle ..... 137/216.1
2,247,566 A * 7/1941 Walton ..... 137/254
2,320,889 A * 6/1943 Rowan ..... 123/41.21
3,610,220 A * 10/1971 Yamada et al. ..... 123/518
4,133,287 A * 1/1979 Downs ..... 116/227
4,142,470 A * 3/1979 Zauss ..... 105/62.1
4,175,616 A * 11/1979 Pabst et al. ..... 165/104.31
5,680,833 A * 10/1997 Smith ..... 123/41.54
5,944,076 A * 8/1999 Palvoelgyi ..... 141/348
6,123,144 A * 9/2000 Morman et al. ..... 165/104.32
6,170,538 B1 * 1/2001 Devall ..... 141/59

* cited by examiner

*Primary Examiner*—Anthony Stashick
*Assistant Examiner*—Madison L Wright
(74) *Attorney, Agent, or Firm*—Global IP Counselors, LLP

(57) ABSTRACT

A vehicle reservoir tank has an anti-spill chamber and an overflow channel. The anti-spill chamber has a body portion, an inlet at one end of the body portion and an outlet at another end of body portion. The anti-spill chamber is configured and arranged to restrict fluid flowing from a main reservoir chamber. The overflow channel has a first end portion, a second end portion and an intermediate curved portion. The first end portion is fluidly coupled to the outlet of the anti-spill chamber. The intermediate curved portion extends from the first end portion to the second end portion such that the second end portion of the overflow channel extends downwardly relative to the first end portion. The second end portion extends along an area of the body portion of the anti-spill chamber to restrict the flow from the anti-spill chamber.

26 Claims, 5 Drawing Sheets

VEHICLE RESERVOIR TANK

BACKGROUND OF THE INVENTION

1. Field of the Invention

The present invention generally relates to a vehicle reservoir tank. More specifically, the present invention relates to a vehicle reservoir tank that prevents the spilling of fluid during vehicle movement.

2. Background Information

Currently, most automotive vehicles use a "water cooled" internal combustion engine. Typically, an engine coolant (liquid) is forcefully circulated by a water pump through a cooling circuit that includes an engine coolant jacket of the engine and an air cooled radiator. The cooling circuit is also typically provided with a vehicle reservoir tank, which is fluidly connected to the radiator, which then provides the engine coolant to the engine. Some vehicle reservoir tanks have an overflow port to prevent the fluid from flooding components of the vehicle.

During vehicle movement, such as transportation of vehicles to a dealer, the vehicle is often tilted and jostled such that the coolant in the reservoir tank is sloshed around and sometimes spills out of the overflow spout. Thus, the coolant or fluid in the vehicle reservoir tank can unnecessarily spill out of the overflow spout. This can result in a loss of coolant as well as a mess in the engine compartment. If too much coolant is loss than a thermal incident can occur when operating the vehicle. Moreover, if the coolant is not cleaned up from the engine compartment after a coolant spill, then a coolant odor can occur during operation of the vehicle.

In view of the above, it will be apparent to those skilled in the art from this disclosure that there exists a need for an improved vehicle reservoir tank that prevents unnecessary spillage of fluid during vehicle movement. This invention addresses this need in the art as well as other needs, which will become apparent to those skilled in the art from this disclosure.

SUMMARY OF THE INVENTION

An object of the present invention is to provide a vehicle reservoir tank that prevents unnecessary spilling of fluid during vehicle movement.

In accordance with one aspect of the present invention, a vehicle reservoir tank includes a main reservoir tank, an anti-spill chamber and an overflow channel. The main reservoir tank has a fluid drain port and an overflow port disposed at an upper portion of the main reservoir tank. The anti-spill chamber has a body portion, an inlet at one end of the body portion and an outlet at another end of the body portion. The inlet is externally coupled to the overflow port of the main reservoir chamber. The anti-spill chamber is configured and arranged to restrict fluid flowing from the main chamber. The overflow channel has a first end portion, a second end portion and an intermediate curved portion. The first end portion is fluidly coupled to the outlet of the anti-spill chamber. The intermediate curved portion extends from the first end portion to the second end portion such that the second end portion extends downwardly relative to the first end portion and extends along an area of the body portion to restrict the flow from the anti-spill chamber.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

The preferred embodiments of the present invention will now be explained with reference to the drawings. It will be apparent to those skilled in the art from this disclosure that the following description of the embodiments of the present invention is provided for illustration only and not for the purpose of limiting the invention as defined by the appended claims and their equivalents.

Figure 1:
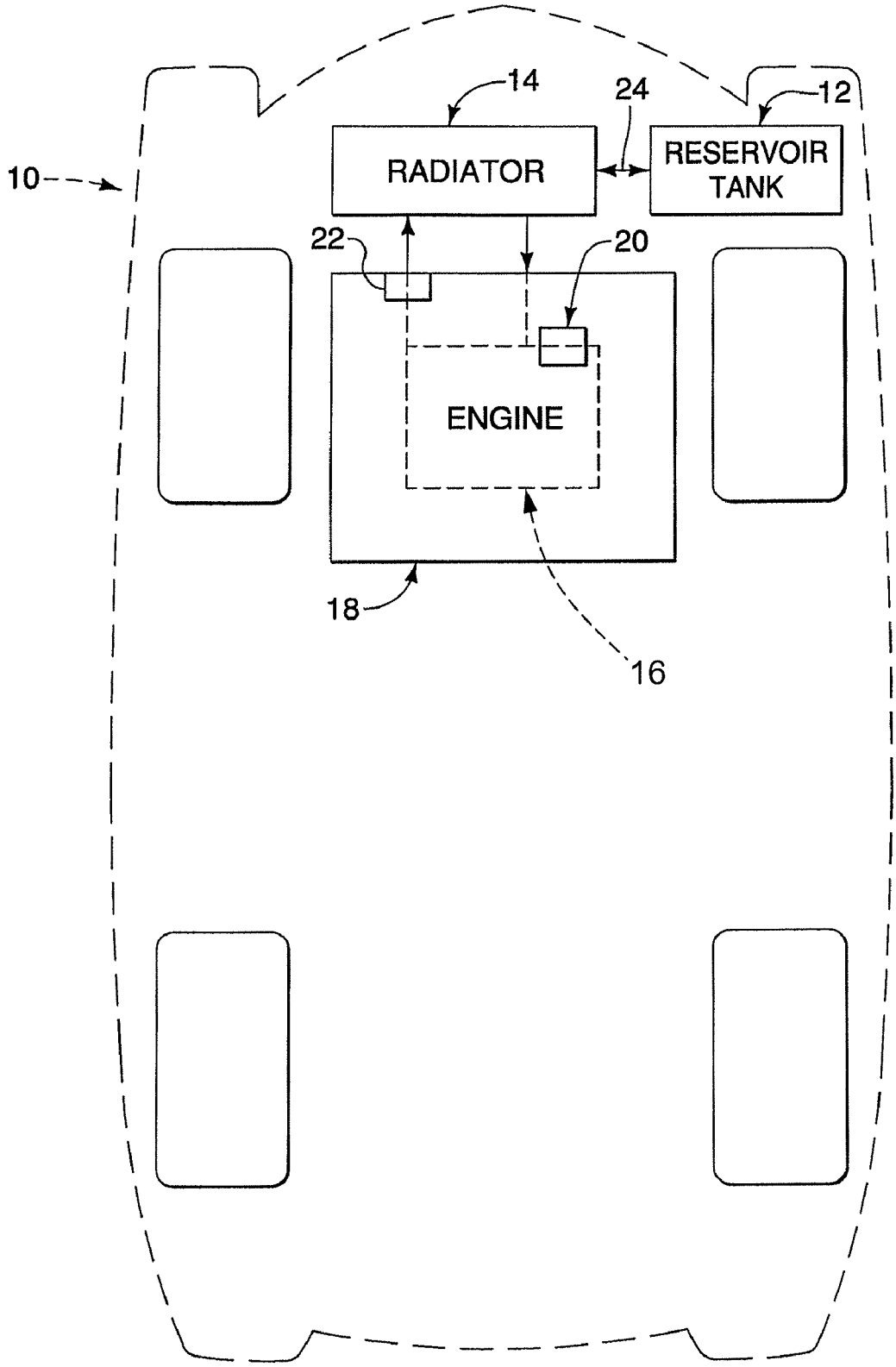
FIG. 1 is a simplified schematic view of a vehicle with a vehicle reservoir tank in accordance with a first embodiment of the present invention.

Referring initially to FIG. 1, a vehicle 10 is schematically illustrated with a vehicle reservoir tank 12 in accordance with a preferred embodiment of the present invention. The vehicle 10 has a cooling circuit that at least includes among other components a radiator 14, a coolant path (water jacket) 16 within an engine 18 and a coolant or water pump 20. Basically, the water pump 20 forces the coolant to circulate within the cooling circuit. A temperature operated valve or thermostat 22 is disposed within the coolant path 16 of the engine 18 to selectively circulate the coolant through the radiator 14. These various components of the cooling circuit, except for the vehicle reservoir tank 12, are conventional components. Thus, these conventional components will not be discussed and/or illustrated in detail herein.

The reservoir tank 12 supplies coolant to the radiator 14 and receives coolant from the radiator 14 via a conduit or hose 24. The reservoir tank 12 is preferably a one-piece, unitary structure with a hollow interior that is molded from a plastic material. The reservoir tank 12 normally stores a predetermined amount of coolant in the interior when the vehicle 10 is parked.

Figure 2:
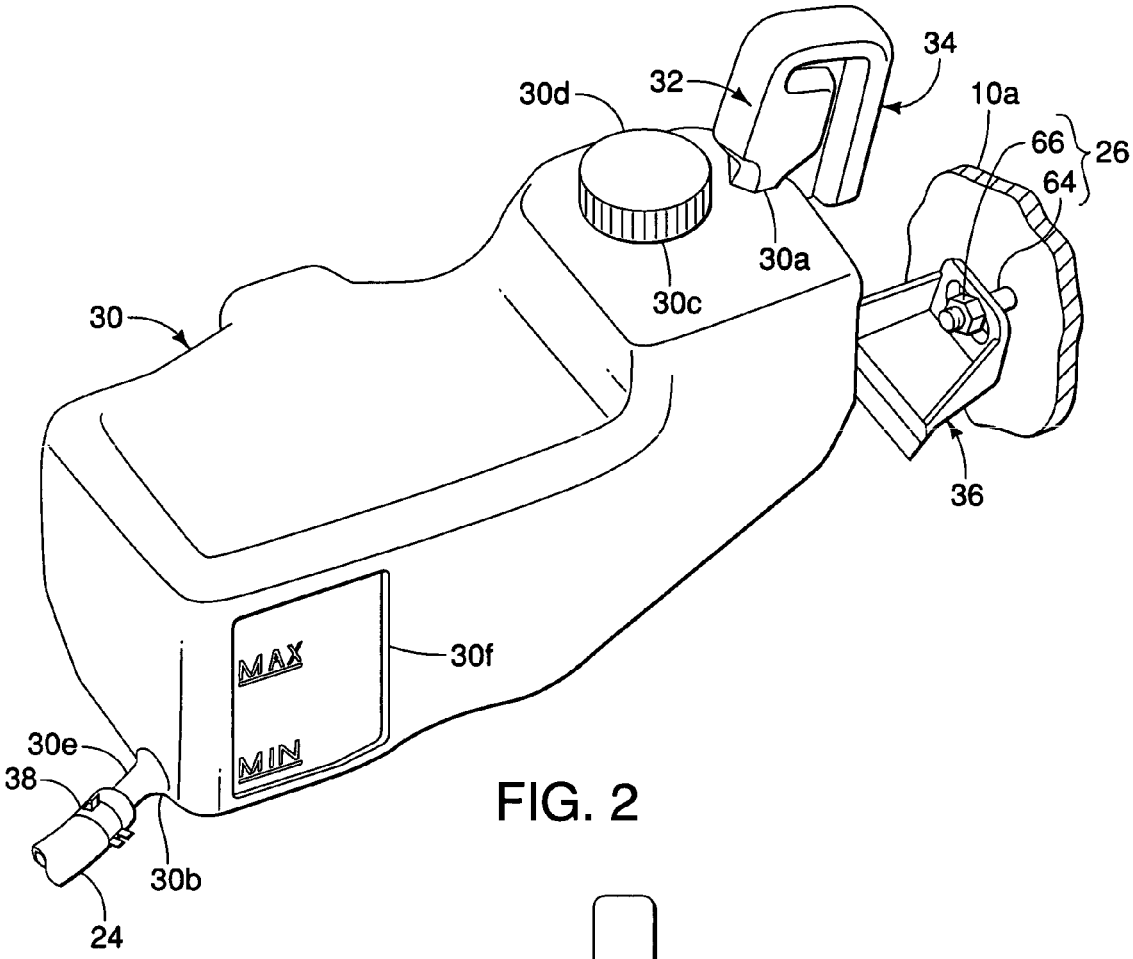
FIG. 2 is a perspective view of the vehicle reservoir tank illustrated in FIG. 1 in accordance with the present invention.

Referring now to FIG. 2, the vehicle reservoir tank 12 is fixedly coupled to an inner wall 10*a* of the vehicle 10 in a conventional manner, e.g. via a fastener 26, as discussed below. The vehicle reservoir tank 12 basically includes a main reservoir chamber 30, an anti-spill chamber 32, an overflow channel 34 and a mounting bracket 36. The main reservoir chamber 30, the anti-spill chamber 32 and the overflow channel 34 form a continuous fluid passage that fluidly connects them together such that coolant can exit the main reservoir chamber 30 via the anti-spill chamber 32 and the overflow channel 34 in the event the coolant level in the main reservoir chamber 30 exceeds the maximum capacity of the main reservoir chamber 30. The anti-spill chamber 32 and the overflow channel 34 are externally coupled to an upper end of the main reservoir chamber 30. The overflow channel 34 is fluidly coupled to the anti-spill chamber 32.

The fluid passage extending through the anti-spill chamber 32 and the overflow channel 34 has a uniform width. The mounting bracket 36 is coupled to a side of the main reservoir chamber 30. The mounting bracket 36 secures the vehicle reservoir tank 12 to the inner wall 10*a* of the vehicle 10.

Figure 4:
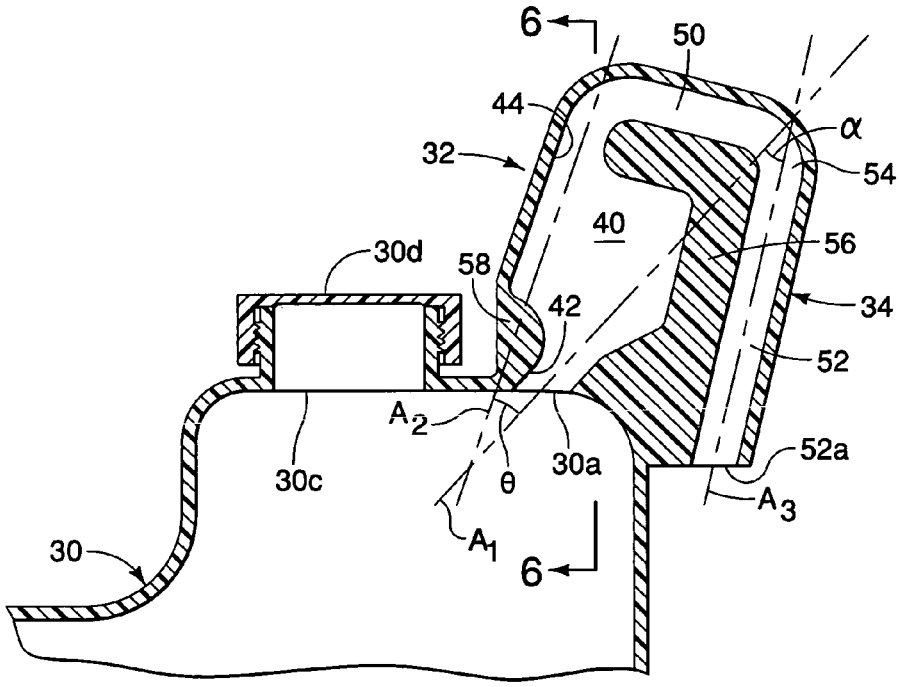
FIG. 4 is a partial cross sectional view of an upper portion of the vehicle reservoir tank illustrated in FIGS. 2 and 3 with an anti-spill chamber in accordance with the present invention.

As best seen in FIGS. 2 and 4, the main reservoir chamber 30 includes an overflow port 30*a*, a fluid drain port 30*b* and a reservoir filling port 30*c*. The reservoir filling port 30*c* of the main reservoir chamber is selectively opened and closed by a reservoir cap 30*d*. The sidewall of the main reservoir chamber preferably includes a fluid level indicator 30*f*. The overflow port 30*a* and the reservoir filling port 30*c* are disposed at an uppermost portion of the main reservoir chamber 30. The overflow port 30*a* has the anti-spill chamber 32 formed thereon. The fluid drain port 30*b* is disposed at a lowermost portion of the main reservoir chamber 30. The fluid drain port 30*b* has a tubular projection 30*e* that is configured to attach to the hose 24. The hose 24 is clamped onto the tubular projection 30*e* by a clamp 38. The reservoir cap 30*d* is configured to close the reservoir filling port 30*c* when installed thereon. The fluid level indicator 30*f* is disposed on the lower portion of the main reservoir chamber 30. Preferably, the fluid level indicator 30*f* is located in the appropriate area to indicate a maximum fluid level and a minimum fluid level.

The main reservoir chamber 30 is a two-tiered structure that includes a large lower tier section and a small upper tier section. The anti-spill chamber 32 is disposed at the upper tier section. The anti-spill chamber 32 is further disposed at a corner of the main reservoir chamber 30. The fluid drain port 30*b* is disposed at an opposite corner of the main reservoir chamber 30 on the lower tier section. Preferably, the anti-spill chamber 32 is located on the uppermost portion of the main reservoir chamber 30 adjacent to the reservoir filling port 30*c*. The main reservoir chamber 30 has a bottom wall that slopes downwardly toward the fluid drain port 30*b* from the end that includes the reservoir filling port 30*c* and the anti-spill chamber 32.

Figure 5:
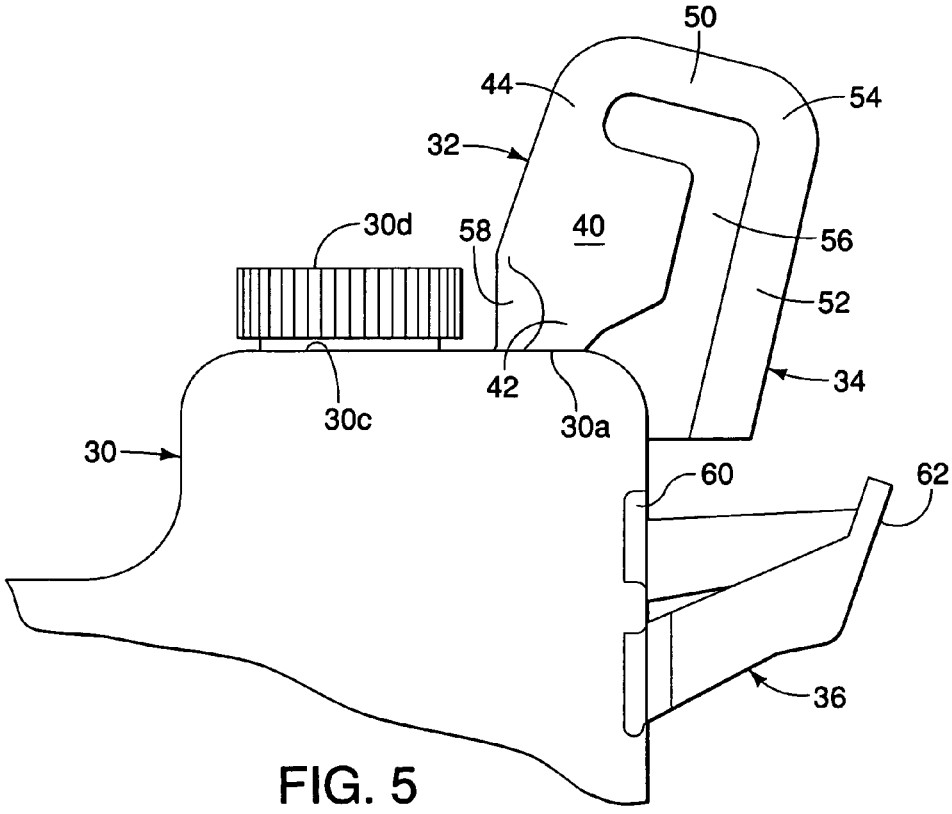
FIG. 5 is an enlarged, partial side elevational view of the upper portion of the vehicle reservoir tank with the anti-spill chamber illustrated in FIG. 4 in accordance with the present invention.

Referring now to FIGS. 4 and 5, the anti-spill chamber 32 basically includes a body portion 40 with an inlet 42 and an outlet 44. The inlet 42 is disposed at a lower end of the body portion 40. The outlet 44 is disposed at an upper end of the body portion 40. The inlet 42 is fluidly coupled to the overflow port 30*a* of the main reservoir chamber 30. The longitudinal axes or centerlines $A_1$ and $A_2$ of the passages of the inlet 42 and the outlet 44 are offset relative to each other. Specifically, the inlet 42 extends upwardly from the overflow port 30*a* of the main reservoir chamber 30. The outlet 44 is located upwardly of the inlet 42. More specifically, the inlet 42 is disposed adjacent a first side of the body portion 40 that is opposite to a second side of the body portion 40. The body portion 40 has a larger transverse cross sectional area than the inlet 42 and the outlet 44 such that the coolant flowing into the body portion 40 of the anti-spill chamber 32 can collect therein before flowing out of the outlet 44 in the event the vehicle is tilted so that the inlet 42 is below the coolant level within the main reservoir chamber 30. The inlet longitudinal axis $A_1$ of the inlet 42 intersects with the outlet longitudinal axis $A_2$ of the outlet 44 to form an acute angle $\theta$ therebetween. In the illustrated embodiment, the angle $\theta$ is about 20° or slightly more than 20°.

The inlet 42 of the anti-spill chamber 32 is configured and arranged as an inlet connecting channel that fluidly communicates the overflow port 30*a* of the main reservoir chamber 30 with the body portion 40 of the anti-spill chamber 32. Similarly, the outlet 44 of the anti-spill chamber 32 is configured and arranged as an outlet connecting channel that fluidly communicates the body portion 40 of the anti-spill chamber 32 with the overflow channel 34. Preferably, the overflow channel 34 and the connecting channels of the inlet 42 and outlet 44 have substantially the same transverse cross sectional areas as measured perpendicular to their longitudinal axes.

Still referring to FIGS. 4 and 5, the overflow channel 34 basically includes a first end portion 50, a second end portion 52 and an intermediate curved portion 54 that together form a continuous fluid passage for the coolant exiting the anti-spill chamber 32. The first end portion 50 is contiguous with and fluidly coupled to the outlet 44 of the anti-spill chamber 32. The intermediate curved portion 54 extends contiguously from the first end portion 50 to the second end portion 52 such that the second end portion 52 extends downwardly relative to the first end portion 50 when the vehicle reservoir tank 12 is installed in the vehicle 10. The second end portion 52 extends along an area of the body portion 40 to restrict the flow of coolant from the empty spill chamber 32. The second end portion 52 has an open end 52*a* that is located downwardly relative to the overflow port 30*a* of the main reservoir chamber 30 when the vehicle reservoir tank 12 is installed in the vehicle 10. The second end portion 52 has a longitudinal axis or centerline $A_3$ that intersects with the inlet longitudinal axis $A_1$ such that the intersection point therebetween is located on one side of the body portion 40. The inlet longitudinal axis $A_1$ and the outlet longitudinal axis $A_2$ intersect at an intersection point that is located on the opposite side of the body portion 40 of the anti-spill chamber 32 relative to the intersection point between the inlet longitudinal axis $A_1$ and the longitudinal axis $A_3$ of the second end portion 52 of the overflow channel 34. The inlet longitudinal axis $A_1$ and the longitudinal axis $A_3$ intersect to form an acute angle $\alpha$ therebetween. In the illustrated embodiment, the angle $\alpha$ is about 30° or slightly less than 30°. Thus, the longitudinal axis $A_3$ of the second end portion 52 is substantially parallel to the inlet longitudinal axis $A_2$ of the outlet 44.

As mentioned above, the anti-spill chamber 32 and the overflow channel 34 are preferably made of molded plastic. Thus, the anti-spill chamber 32 and the overflow channel 34 are a one piece unitary structure in the illustrated embodiment. Likewise, in the illustrated embodiment, the main reservoir chamber 30 and the anti-spill chamber 32 are a one piece unitary structure. Specifically, the main reservoir chamber 30, the anti-spill chamber 32, the overflow channel 34 and the mounting bracket 36 are a one piece unitary structure in the illustrated embodiment. The main reservoir chamber 30, the anti-spill chamber 32 and the overflow channel 34 are integrally molded together.

The anti-spill chamber 32 further includes a first reinforcement member or rib 56 and a second reinforcement member or rib 58. These reinforcement members 56 and 58 are configured and arranged to provide rigidity to the anti-spill chamber 32 and the connection of the anti-spill chamber 32 to the main reservoir chamber 30. The first reinforcement member 56 is disposed on a first side of the inlet 42 of the anti-spill chamber 32, and interconnects the body portion 40, the inlet 42, the outlet 44 and the overflow channel 34 all together as well as interconnects the anti-spill chamber 32 to the upper corner of the main reservoir chamber 30. Thus, the first reinforcement member 56 is a thin sheet of material that is thinner than the widths of the body portion 40, the inlet 42 and the overflow channel 34. Specifically, the first reinforcement member 56 is located between the first end portion 50 and the upper end of the body portion 40. The first reinforcement member 56 follows a curve of the intermediate curved portion 54 and extends downwardly from the intermediate curved portion 54 along the second end portion 52 to the main reservoir chamber 30. The second reinforcement member 58 is disposed on a second side of the inlet 42 of the anti-spill chamber 32, and interconnects the body portion 40 and the inlet 42 together as well as interconnects the anti-spill chamber 32 to the upper corner of the main reservoir chamber 30. Thus, the second reinforcement member 58 is a thin sheet of material that is thinner than the widths of the body portion 40, the inlet 42 and the overflow channel 34, and is disposed along the inlet 42 on the opposite side relative to the first reinforcement member 56. The first and second reinforcement members 56 and 58 preferably have the same thickness and lie in the same plane that bisects the vehicle reservoir tank 12 in half. The first and second reinforcement members 56 and 58 provide a rigid structure that supports the overflow channel 34 with the anti-spill chamber 32. The first and second reinforcement members 56 and 58 rigidly reinforce the fluid connection of the inlet 42 to the overflow port 30*a*. The first reinforcement member 56 and the second reinforcement member 58 are integrally molded with the main reservoir chamber 30 and the rest of the anti-spill chamber 32.

Figure 3:
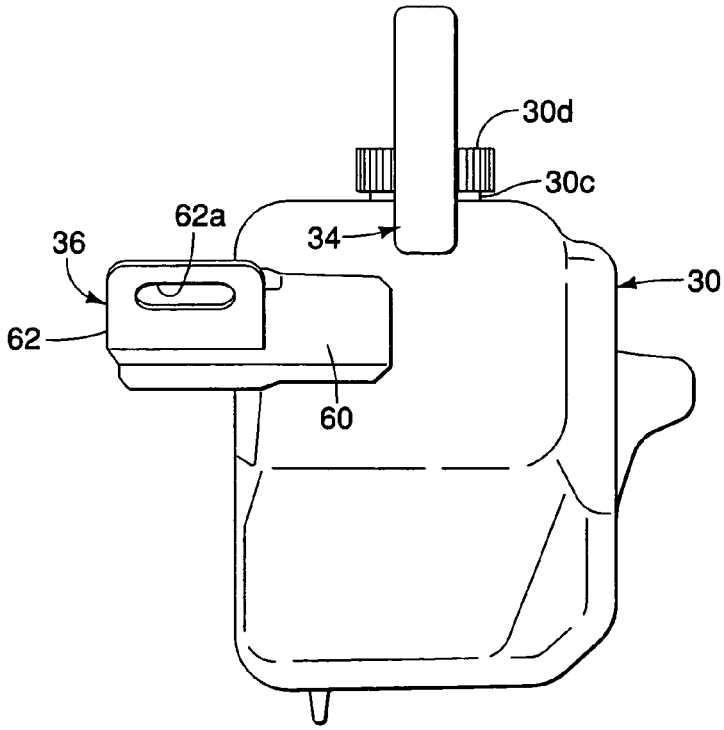
FIG. 3 is an end elevational view of the vehicle reservoir tank illustrated in FIG. 2 in accordance with the present invention.

As best seen in FIGS. 2 and 3, the mounting bracket 36 extends substantially perpendicularly from the end of the main reservoir chamber 30 that has the anti-spill chamber 32. The mounting bracket 36 basically includes a first fixed section 60 and a second fixed section 62. The first fixed section 60 is fixedly coupled to the main reservoir chamber 30 at one end and supports the second fixed section 62 at its free end in a cantilevered manner. The second fixed section 62 is preferably attached to the inner wall 10*a* of the vehicle 10. Preferably, the second fixed section 62 is secured to the inner wall 10*a* by the fastener 26 that can include for example a bolt 64 and a nut 66. It will be apparent to one of ordinary skill in the art from this disclosure that the fixed section 62 can be attached to the inner wall 10*a* in a variety of ways as needed and/or desired for the particular vehicle.

Figure 6:
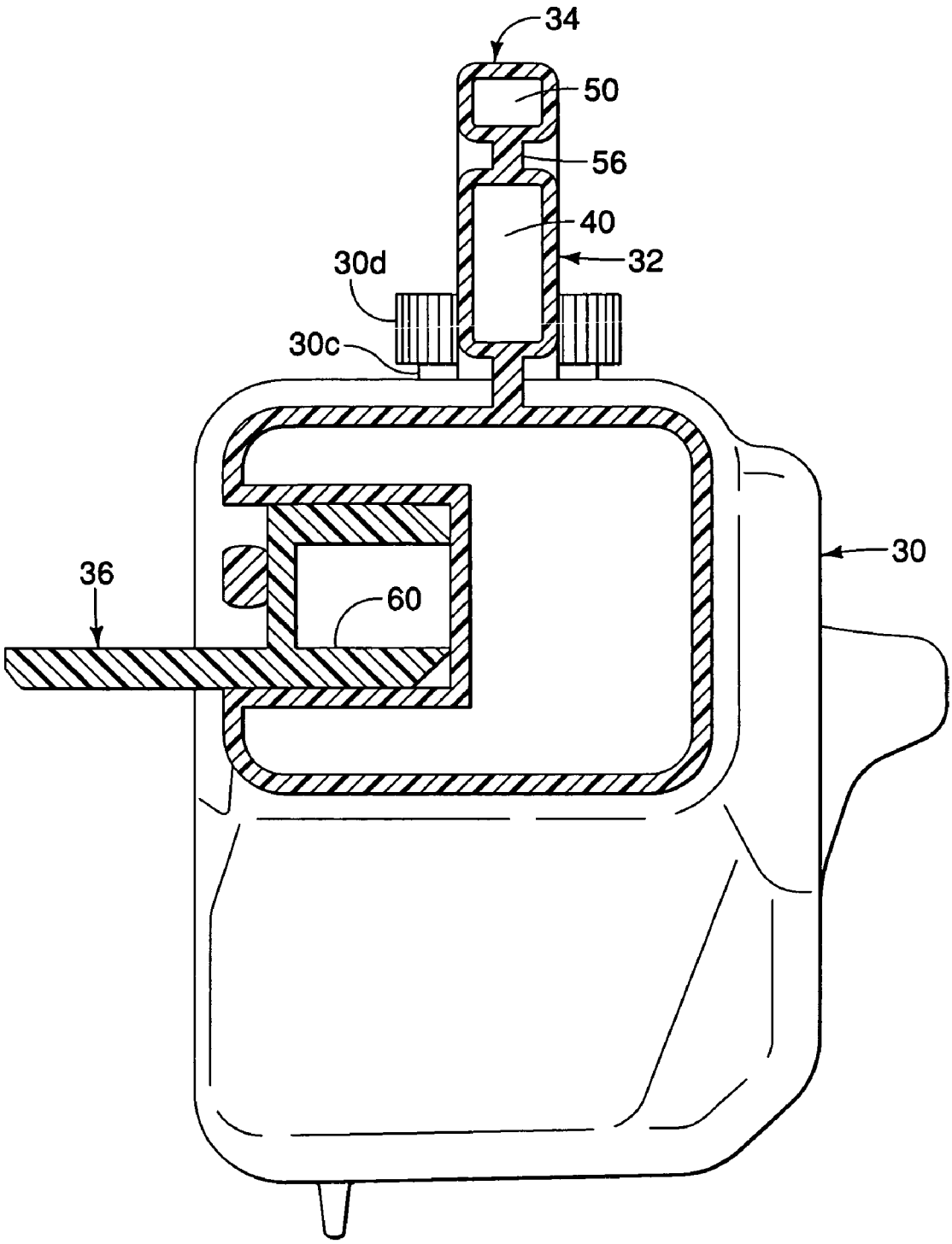
FIG. 6 is a cross sectional view of the vehicle reservoir tank illustrated in FIGS. 2 to 5 as seen along section line 6-6 of FIG. 4.

Referring to FIG. 3, the mounting bracket 36 also extends substantially perpendicularly to one side of the main reservoir chamber 30 such that a portion of the mounting bracket 36 is offset outwardly from the main reservoir chamber 30. The bolt 64 extends through a through hole 62*a* of the second fixed section 62 of the mounting bracket 36. In the illustrated embodiment, the mounting bracket 36 is a separate member from the main reservoir chamber 30 that is mechanically attached to the main reservoir chamber 30. In particular, the main reservoir chamber 30 has a recess on its end wall that retains a first end portion of the first fixed section 60 via a snap-fit arrangement as seen in FIG. 6. The mounting bracket 36 can be made of metal, plastic or any other rigid material as needed and/or desired. Alternatively, the first fixed section 60 can be attached to the main reservoir chamber 30 by adhesive or the like. It will be apparent to one of ordinary skill in the art from this disclosure that the mounting bracket 36 can be integrally molded with the main reservoir chamber 30 if needed and/or desired.

Second Embodiment

Figure 7:
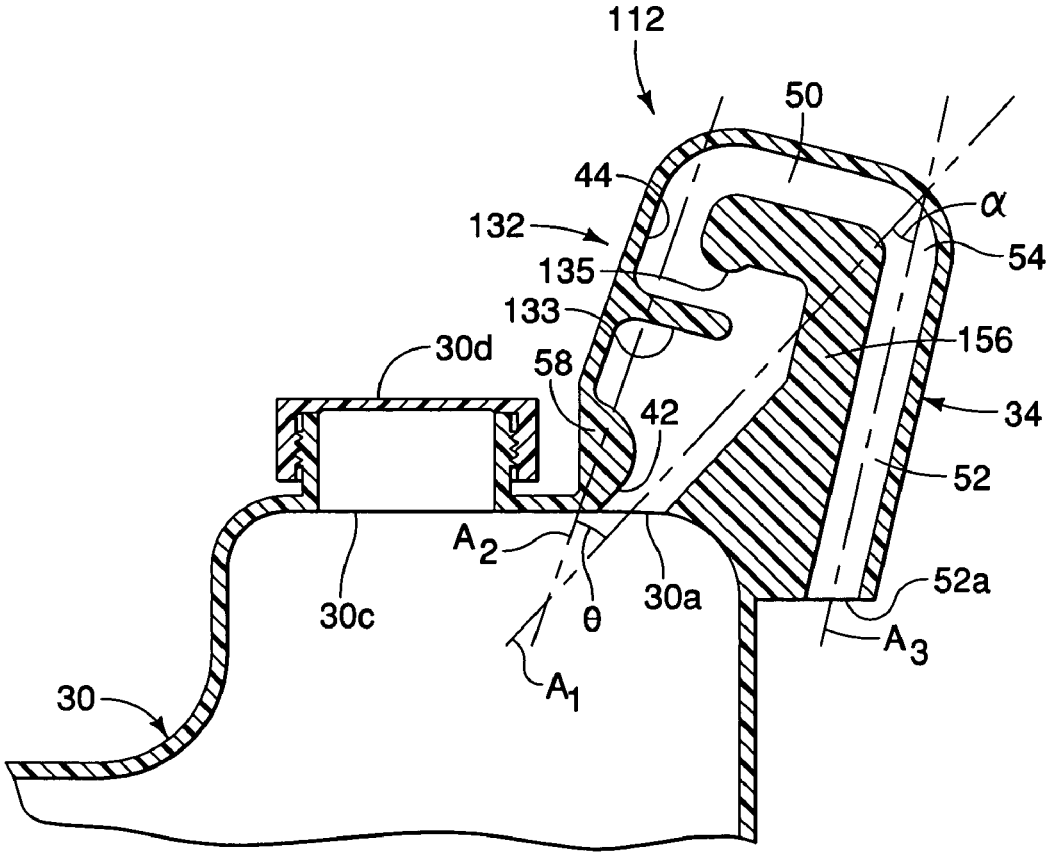
FIG. 7 is a partial cross sectional view of an upper portion of the vehicle reservoir tank illustrated in FIG. 4 with an anti-spill chamber in accordance with a second embodiment of the present invention.

Referring now to FIG. 7, a vehicle reservoir tank 112 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The reservoir tank 112 of the second embodiment is similar to the reservoir tank 12 of the first embodiment, except that an anti-spill chamber 132 is provided with a baffle 133, a lip 135 and a first reinforcement member 156. The baffle 133 extends into the anti-spill chamber 132. The width of the baffle 133 is the same as that of the width of the anti-spill chamber 132. The length of the baffle 133 is greater than a diameter of the outlet 44. The baffle 133 is disposed on an interior surface of the anti-spill chamber 132 between the inlet 42 and the outlet 44. The baffle 133 prevents coolant from traveling on a linear path between the inlet 42 and the outlet 44. The lip 135 also extends into the anti-spill chamber 132. A length and width of the lip 135 is configured and arranged to disturb the flow of the coolant in the anti-spill chamber 132. The lip 135 is disposed adjacent the outlet 44.

The anti-spill chamber 132 has a substantially planar surface extending from the inlet 42 to a point across the anti-spill chamber 132 from the baffle 133. The first reinforcement member 156 is provided to support the substantially planar surface of the anti-spill chamber 132.

As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only preferred embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents. Thus, the scope of the invention is not limited to the disclosed embodiments.

What is claimed is:

1. A vehicle reservoir tank comprising:

a main reservoir chamber having a fluid drain port and an overflow port disposed at an upper portion of the main reservoir chamber;

an anti-spill chamber having a body portion, an inlet disposed at a lowermost section of the body portion and an outlet disposed exclusively above the inlet at an uppermost section of the body portion with the inlet being externally coupled to the overflow port of the main reservoir chamber, the anti-spill chamber being configured and arranged to restrict fluid flowing from the main reservoir chamber;

an overflow channel having a first end portion fluidly coupled to the outlet of the anti-spill chamber at the uppermost section of the body portion, and an intermediate curved portion extending from the first end portion to a second end portion such that the second end portion of the overflow channel extends downwardly relative to the first end portion and extends along an area of the body portion of the anti-spill chamber, with the fluid flowing above the uppermost section of the body portion after exiting via the outlet toward the overflow channel in a condition of overflow; and a reinforcement member disposed between the overflow channel and the area of the body portion of the anti-spill chamber.

2. The vehicle reservoir tank according to claim 1, wherein the inlet and the outlet of the anti-spill chamber are offset relative to each other.

3. The vehicle reservoir tank according to claim 1, wherein the inlet of the anti-spill chamber is disposed adjacent a first side of the body portion of the anti-spill chamber that is opposite to a second side of the body portion of the anti-spill chamber, which includes the area where the second end portion of the overflow channel is located.

4. The vehicle reservoir tank according to claim 1, wherein the inlet of the anti-spill chamber has an inlet longitudinal axis that intersects with an outlet longitudinal axis of the outlet of the anti-spill chamber to form an acute angle therebetween.

5. The vehicle reservoir tank according to claim 4, wherein the second end portion of the overflow channel has a longitudinal axis that intersects with the inlet longitudinal axis such that an intersection point therebetween is located on one side of the body portion of the anti-spill chamber.

6. The vehicle reservoir tank according to claim 5, wherein the inlet longitudinal axis and the outlet longitudinal axis intersect at an intersection point that is located on an opposite side of the body portion of the anti-spill chamber relative to the intersection point between the inlet longitudinal axis and the longitudinal axis of the second end portion of the overflow channel.

7. The vehicle reservoir tank according to claim 1, wherein the body portion of the anti-spill chamber has a larger transverse cross sectional area than the inlet and the outlet of the anti-spill chamber.

8. The vehicle reservoir tank according to claim 1, wherein the inlet of the anti-spill chamber includes an inlet connecting channel fluidly communicating the overflow port of the main reservoir chamber with the anti-spill chamber.

9. The vehicle reservoir tank according to claim 8, wherein the outlet of the anti-spill chamber includes an outlet connecting channel fluidly communicating the first end portion of the overflow channel to the anti-spill chamber, with the inlet and outlet connecting channels being offset relative to each other.

10. The vehicle reservoir tank according to claim 8, further comprising a first reinforcement member disposed between the inlet connecting channel and the overflow channel; and a second reinforcement member disposed along the inlet connecting channel on a side opposite to the first reinforcement member.

11. The vehicle reservoir tank according to claim 1, wherein the reinforcement member, the overflow channel and the anti-spill chamber are a one-piece unitary structure.

12. The vehicle reservoir tank according to claim 1, wherein the main reservoir chamber and the anti-spill chamber are a one-piece unitary structure.

13. The vehicle reservoir tank according to claim 1, wherein the second end portion of the overflow channel has an open end that is located downwardly relative to the overflow port of the main reservoir chamber.

14. The vehicle reservoir tank according to claim 1, wherein the anti-spill chamber includes a baffle arranged between the inlet and outlet to prevent fluid from flowing on a linear path between the inlet and outlet.

15. The vehicle reservoir tank according to claim 14, wherein the baffle is located in front of the outlet and is dimensioned to be equal to or greater than an opening of the outlet.

16. The vehicle reservoir tank according to claim 14, wherein the anti-spill chamber includes a lip located adjacent the outlet and extending towards the baffle to disturb fluid flow in the anti-spill chamber prior to entering the outlet.

17. The vehicle reservoir tank according to claim 1, wherein the anti-spill chamber includes a lip located adjacent the outlet and extending in a direction to disturb fluid flow in the anti-spill chamber prior to entering the outlet.

18. The vehicle reservoir tank according to claim 1, wherein the reinforcement member is contoured to direct fluid entering the body portion toward the overflow port.

19. The vehicle reservoir tank according to claim 1, wherein the reinforcement member divides the body portion from the overflow channel such that the body portion is in fluid communication with the overflow channel only through the outlet and the first end portion.

20. The vehicle reservoir tank according to claim 19, wherein the reinforcement member is positioned on a first side of the body portion, and the outlet is positioned on a second side of the body portion, the first side being opposite the second side.

21. The vehicle reservoir tank according to claim 1, wherein the anti-spill chamber is directly coupled to the main reservoir chamber.

22. The vehicle reservoir tank according to claim 21, wherein the overflow port of the main reservoir chamber is directly aligned with the inlet.

23. A vehicle reservoir tank comprising:

a main reservoir chamber having a fluid drain port and an overflow port disposed at an upper portion of the main reservoir chamber;

an anti-spill chamber having a body portion, an inlet at one end of the body portion and an outlet at another end of the body portion with the inlet being externally coupled to the overflow port of the main reservoir chamber, the anti-spill chamber being configured to restrict fluid flowing from the main reservoir chamber, the inlet of the anti-spill chamber having an inlet longitudinal axis that intersects with an outlet longitudinal axis of the outlet of the anti-spill chamber to form an acute angle therebetween; and an overflow channel having a first end portion fluidly coupled to the outlet of the anti-spill chamber, and an intermediate curved portion extending from the first end portion to a second end portion such that the second end portion of the overflow channel extends downwardly relative to the first end portion and extends along an area of the body portion of the anti-spill chamber.

24. The vehicle reservoir tank according to claim 23, wherein the second end portion of the overflow channel has a longitudinal axis that intersects with the inlet longitudinal axis such that an intersection point therebetween is located on one side of the body portion of the anti-spill chamber.

25. The vehicle reservoir tank according to claim 24, wherein the inlet longitudinal axis and the outlet longitudinal axis intersect at an intersection point that is located on an opposite side of the body portion of the anti-spill chamber relative to the intersection point between the inlet longitudinal axis and the longitudinal axis of the second end portion of the overflow channel.

26. The vehicle reservoir tank according to claim 23, wherein the inlet longitudinal axis and the outlet longitudinal axis intersect below the inlet of the anti-spill chamber, and the second end portion of the overflow channel has a longitudinal axis that intersects with the inlet longitudinal axis such that an intersection point therebetween is located above the inlet of the anti-spill chamber.

* * * * *